US008037624B2

(12) United States Patent
McKeown et al.

(10) Patent No.: US 8,037,624 B2
(45) Date of Patent: Oct. 18, 2011

(54) MULITFUNCTIONAL DEVICE FOR CLEARING SNOW

(75) Inventors: Stephen Lyle McKeown, Campbellford (CA); Daniel Andrew Faux, Kingston (CA)

(73) Assignee: 3RD Millennium Solutions, Ltd., Campbellford, Ontario ( * ) Notice: Subject to any disclaimer, the term of this patent is extended or adjusted under 35 U.S.C. 154(b) by 14 days.

(21) Appl. No.: 12/707,874

(22) Filed: Feb. 18, 2010

(65) Prior Publication Data

US 2010/0205834 A1 Aug. 19, 2010

Related U.S. Application Data

(60) Provisional application No. 61/153,445, filed on Feb. 18, 2009.

(51) Int. Cl.
*E01H 5/02* (2006.01)

(52) U.S. Cl. ..... 37/197

(58) Field of Classification Search ..... 37/196, 37/197, 255, 256, 261, 276, 227, 232, 233, 37/242, 248, 251, 253; 172/107; 126/271.2 R, 126/271.2 C; 15/21.1, 49.1, 52.2, 54, 55, 15/52.1, 53.2, 88.4, 84, 87
See application file for complete search history.

(56) References Cited

U.S. PATENT DOCUMENTS

| | | | |
|---|---|---|---|
| 0,538,781 | A | 5/1895 | Hollingsworth |
| 0,644,739 | A | 3/1900 | Greeley et al. |
| 1,844,706 | A | 2/1932 | Wandscheer |
| 2,175,542 | A | 10/1939 | Robarge |
| 2,369,293 | A | 2/1945 | Gotzlinger |
| 2,679,702 | A | 6/1954 | Berger |
| 3,034,236 | A | 5/1962 | Pyke |
| 3,053,460 | A | 9/1962 | Rudy |
| 3,056,218 | A | 10/1962 | Denovan et al. |
| 3,164,913 | A | 1/1965 | Hanson |
| 3,296,717 | A | 1/1967 | Sedore |
| 3,431,571 | A | 3/1969 | Kraus |
| 3,457,574 | A | 7/1969 | Hirt |
| 3,461,578 | A | 8/1969 | Van Der Lely et al. |
| 3,539,014 | A | 11/1970 | Jonsson |
| 3,735,510 | A | 5/1973 | Godfrey et al. |

(Continued)

FOREIGN PATENT DOCUMENTS

| | | | |
|---|---|---|---|
| CA | 549502 | A | 12/1957 |

(Continued)

OTHER PUBLICATIONS

International Search Report and Written Opinion for PCT/CA2010/000213 dated May 19, 2010.

*Primary Examiner* — Robert Pezzuto
(74) *Attorney, Agent, or Firm* — Pearne & Gordon LLP

(57) ABSTRACT

An apparatus and a method of clearing an accumulation of matter from a surface is provided. The apparatus includes a collecting section, a casting section, and a shifting section. The shifting section is at least one of a diverting section, a sweeping section, and an air blowing section. The collecting section includes a blade and is in matter communication with the casting section. The diverting section includes an auxiliary blade oriented at an angle about an axis transverse to a direction of travel. The sweeping section includes a rotatable broom with bristles. The air blowing section is configured to blow air in a predetermined direction.

3 Claims, 17 Drawing Sheets

U.S. PATENT DOCUMENTS

| | | | | | |
|---|---|---|---|---|---|
| 3,748,675 | A | | 7/1973 | Schultz | |
| 3,748,680 | A | | 7/1973 | Griffin | |
| 3,790,981 | A | | 2/1974 | Young | |
| 3,922,745 | A | | 12/1975 | Lehman | |
| 3,945,155 | A | | 3/1976 | Leliaert | |
| 4,084,285 | A | | 4/1978 | Herzog | |
| 4,125,915 | A | | 11/1978 | Zamboni | |
| 4,158,923 | A | * | 6/1979 | Steiner et al. | 37/256 |
| 4,290,820 | A | | 9/1981 | Swisher, Jr. et al. | |
| 4,327,666 | A | | 5/1982 | Lee | |
| 4,414,699 | A | | 11/1983 | Hirt | |
| 4,490,874 | A | | 1/1985 | Duncan | |
| 4,858,270 | A | * | 8/1989 | Boschung | 15/328 |
| 5,115,531 | A | | 5/1992 | Suzuki | |
| 5,769,954 | A | | 6/1998 | Wanner | |
| 6,560,905 | B2 | * | 5/2003 | Monroe | 37/248 |
| 6,748,678 | B2 | | 6/2004 | Verseef | |

FOREIGN PATENT DOCUMENTS

| | | | |
|---|---|---|---|
| CA | 640135 | A | 4/1962 |
| DE | 1122975 | | 2/1962 |
| DE | 8909243 | | 9/1989 |
| DE | 3928914 | | 3/1991 |

* cited by examiner

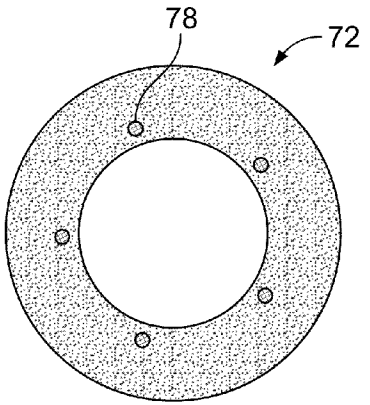
FIG. 5A
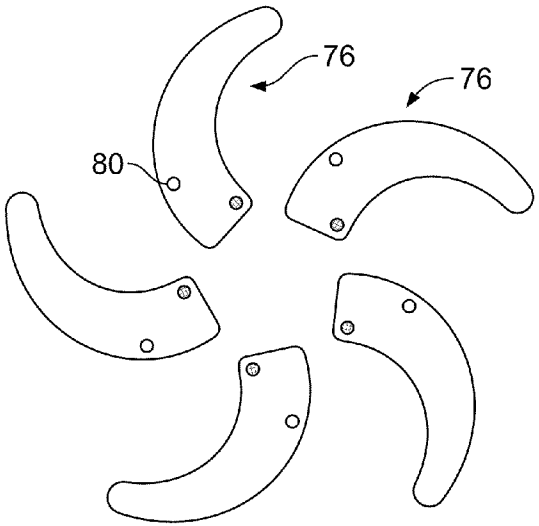
FIG. 5B
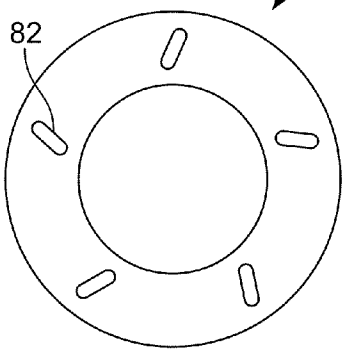
FIG. 5C
FIG. 5D
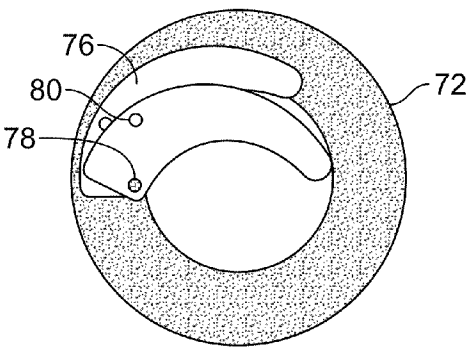
FIG. 5E
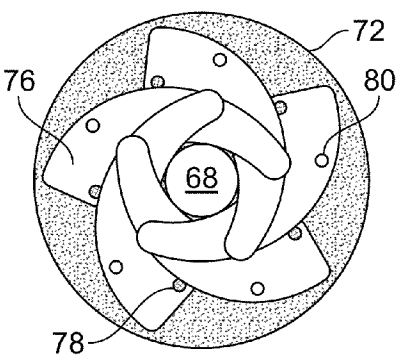
FIG. 5F

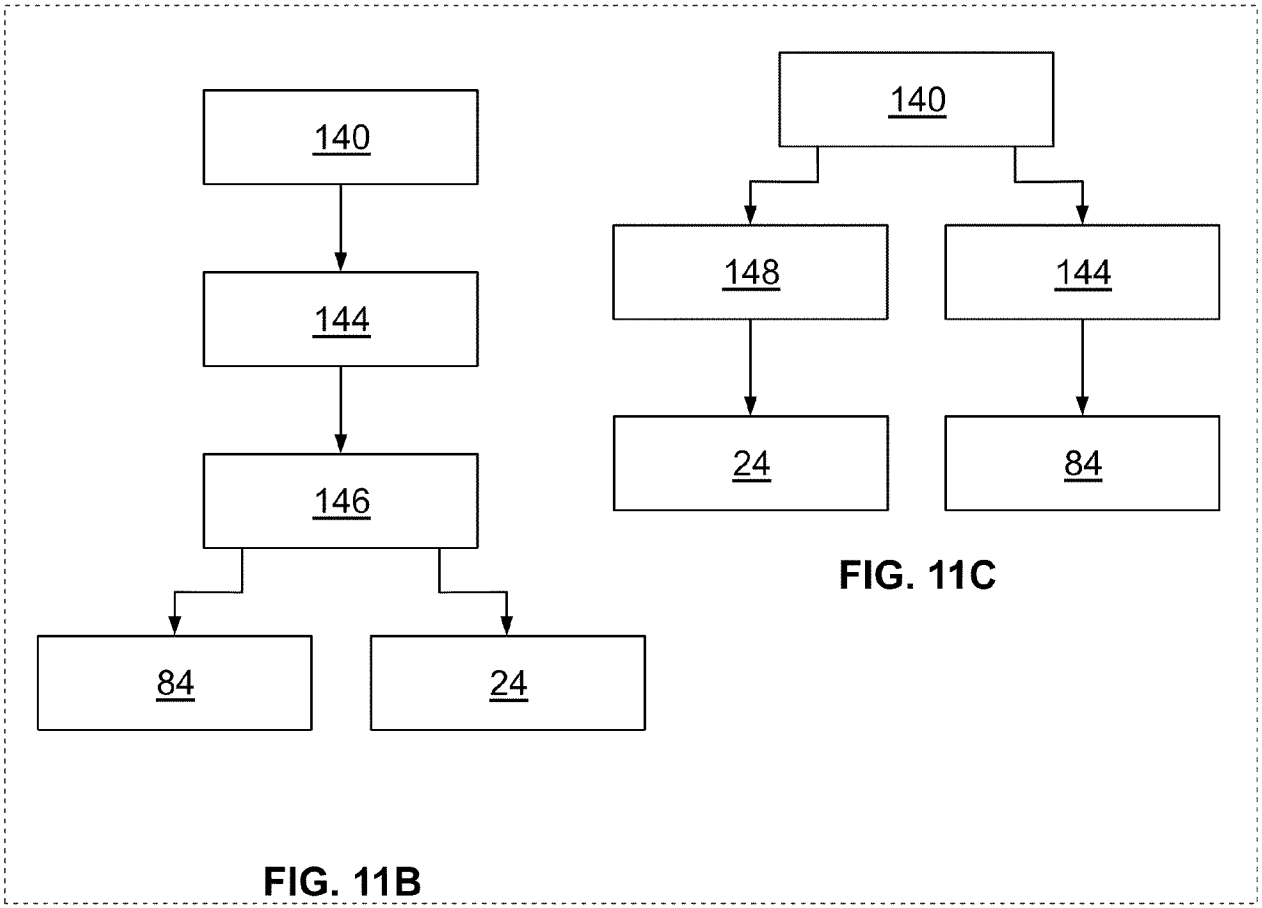
FIG. 11B
FIG. 11C
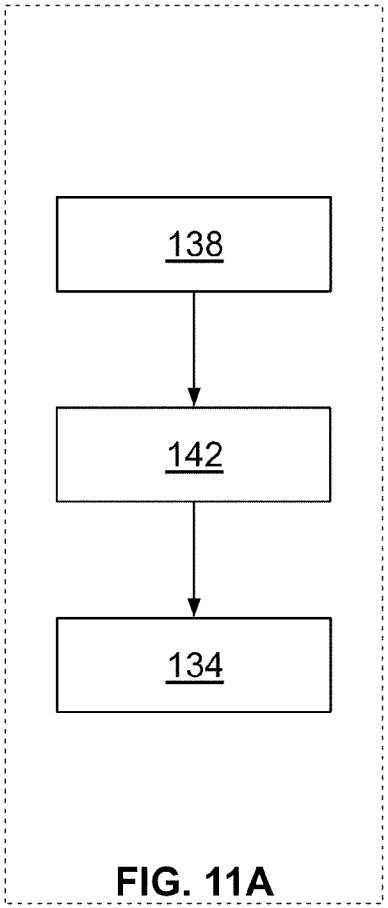
FIG. 11A

MULITFUNCTIONAL DEVICE FOR CLEARING SNOW

CROSS-REFERENCE TO RELATED APPLICATIONS

This application claims the benefit of U.S. Provisional Application No. 61/153,445, filed Feb. 18, 2009, the entire disclosure of which is hereby incorporated herein by reference.

TECHNICAL FIELD

The present disclosure relates to apparatus and methods for clearing matter off of a surface and, more particularly, a vehicle for clearing snow off of a runway surface of an airport.

BACKGROUND

Devices for clearing accumulation of matter, such as snow, from a surface and methods of using such devices are known in the art. Generally, it is necessary to clear matter that is accumulated over a vast area and such a task must be completed efficiently to allow the surface to be used for its designated purpose (e.g., passage of traffic). Thus, there is a need for ways to improve the ability of conventional surface clearing devices to accomplish their tasks effectively and efficiently.

SUMMARY

The following presents a simplified summary of the disclosure in order to provide a basic understanding of some example aspects described in the detailed description.

In one example aspect, an apparatus for clearing an accumulation of matter from a surface is provided. The apparatus includes a blade, a first ribbon and a second ribbon. The blade is configured to collect matter upon movement of the apparatus and includes a central portion and lateral portions. The first ribbon and a second ribbon are located adjacent the blade and are arranged helically about a first axis and a second axis respectively so as to be farther radially from the first axis and the second axis respectively near the central portion than near the lateral portions. The first ribbon and the second ribbon are rotatable about the first axis and the second axis respectively.

In another example aspect, the lateral portions of the blade are located forwardly of the central portion during forward movement of the apparatus so as to direct matter toward the central portion of the blade.

In yet another example aspect, the central portion of the blade leads to an impeller.

In yet another example aspect, the blade has a substantially angled configuration.

In yet another example aspect, each of the first axis and the second axis forms an acute angle with a transversal axis.

In yet another example aspect, the blade is taller near the central portion than the lateral portions.

In yet another example aspect, each of the first ribbon and the second ribbon forms at least a section of a cone where the cone has a vertex and a base.

In yet another example aspect, the first axis and the second axis are oriented at an angle relative to ground such that a side of each cone extending from the vertex to the base is substantially parallel to ground.

In yet another example aspect, a pitch between revolutions of each of the first ribbon and the second ribbon increases toward the base of each cone.

In yet another example aspect, a rotational speed of the first ribbon and the second ribbon is adjustable.

In yet another example aspect, the first axis and the second axis are not coaxial.

In yet another example aspect, an apparatus for clearing an accumulation of matter from a surface is provided. The apparatus includes a blade and a chamber. The blade is configured to collect matter upon movement of the apparatus. The chamber is located adjacent the blade and in communication with the blade, and includes a rotor with blades rotatable about a primary axis. The blades are oriented substantially parallel to the primary axis and extend from a central area of the chamber to a perimeter of the chamber. The blades are capable of being adjusted to non-radial orientations.

In yet another example aspect, the rotor is rotatable in either clockwise or counterclockwise directions.

In yet another example aspect, the blades are capable of being adjusted to radial orientations.

In yet another example aspect, the blades respectively include a secondary axis that is parallel to the primary axis and lies on a plane of each of the blades, and each of the blades is rotatably adjustable about the secondary axis.

In yet another example aspect, each of the blades is rotatably adjustable about the secondary axis in either clockwise or counterclockwise directions.

In yet another example aspect, each of the blades is coupled so as to be rotatably adjusted simultaneously.

In yet another example aspect, the chamber includes an inner plate and an outer plate. The inner plate and the outer plate are configured concentrically about the primary axis and are rotatably adjustable about one another. The blades respectively include an inner end and an outer end. The inner ends are coupled to the inner plate and the outer ends are coupled to the outer plate such that rotation of one of the inner plate and the outer plate with respect to the other of the inner plate and the outer plate can adjust the blades to the non-radial orientations.

In yet another example aspect, the one of the inner plate and the outer plate are rotatable about the other of the inner plate and the outer plate in either clockwise or counterclockwise fashion.

In yet another example aspect, the inner ends respectively are coupled to the inner plate through an inner rod extending parallel to the primary axis. The outer ends are respectively coupled to the outer plate through an outer rod extending parallel to the primary axis.

In yet another example aspect, the outer plate includes holes in which the outer rods can rotate, and the inner plate includes radial slots along which the inner rods can travel as the orientations of the blades are adjusted.

In yet another example aspect, the blade includes a central portion with an outlet. The chamber further includes an inlet end and radial openings, the inlet end in communication with the outlet.

In yet another example aspect, an apparatus for clearing an accumulation of matter from a surface is provided. The apparatus includes a blade and a chamber. The blade is configured to collect matter upon movement of the apparatus, and includes a central portion. The chamber is located adjacent the blade and in communication with the blade. The chamber includes a rotor with blades rotatable about a primary axis. Each of the blades extends partially along a plane that is oriented parallel to the primary axis. The blades respectively include a first curved portion that is flared away from the plane in a first rotational direction and a second curved portion that is flared away from the plane a second rotational direction.

In yet another example aspect, the chamber includes an inlet end in communication with the central portion of the blade. The inlet end is defined by a ring. The first curved portion transitions between the plane and the ring, and the second curved portion transitions between the plane and the ring.

In yet another example aspect, the rotor is rotatable in either clockwise or counterclockwise directions.

In yet another example aspect, an apparatus for clearing an accumulation of matter from a surface is provided. The apparatus includes a blade, a chamber and a sealing element. The blade is configured to collect matter upon movement of the apparatus, and includes a central portion. The chamber is located adjacent the blade and includes an inlet end in communication with the central portion of the blade. The chamber includes a rotor with blades rotatable about a primary axis. The sealing element is located on the inlet end and includes an opening with a predetermined area.

In yet another example aspect, the sealing element is defined by an annular plate.

In yet another example aspect, the sealing element is configured such that the predetermined area is adjustable.

In yet another example aspect, the sealing element includes an annular base, an annular actuator and a plurality of shutter pieces. The annular base includes pivot points about which the shutter pieces can rotate. The shutter pieces respectively include an actuated point. The actuator includes slots along which the actuated point of each of the shutter pieces can travel. The annular base is rotatable adjustable with respect to the actuator so as to cause the shutter pieces to rotate thereby decreasing or increasing the predetermined area.

In yet another example aspect, the rotor is rotatable in either clockwise or counterclockwise directions.

In yet another example aspect, an apparatus for clearing an accumulation of matter from a surface is provided. The apparatus includes a blade, a chamber, and a guide. The blade is configured to collect matter upon movement of the apparatus and includes a central portion. The chamber is located adjacent the blade and is in communication with the central portion of the blade. The chamber includes a rotor with blades rotatable about a primary axis and includes a first radial opening and a second radial opening. The guide is configured to emit matter moved by rotation of the rotors. The guide includes an inlet and an outlet and is movable such that the inlet is in communication with either the first radial opening or the second radial opening.

In yet another example aspect, the guide is movable laterally on top of the chamber.

In yet another example aspect, the guide is slidably movable through a set of rails.

In yet another example aspect, a vehicle for clearing an accumulation of matter from a surface is provided. The vehicle includes a collecting section, a casting section, and a shifting section. The collecting section includes a blade. The casting section is in matter communication with the collecting section and is configured to cast matter channeled from the collecting section. The shifting section is configured to shift matter laterally of the vehicle.

In yet another example aspect, relative to forward movement of the apparatus, the shifting section is rearward of the collecting section and the casting section.

In yet another example aspect, the shifting section is at least one of a diverting section, a sweeping section, and an air blowing section. The diverting section includes an auxiliary blade oriented at an angle about an axis transverse to a direction of travel. The sweeping section includes a rotatable broom with bristles. The air blowing section is configured to blow air in a predetermined direction.

In yet another example aspect, the broom is oriented at an angle about the axis.

In yet another example aspect, the vehicle includes the diverting section, the sweeping section and the air blowing section.

In yet another example aspect, the vehicle includes a mobilizing section including a front set of wheels and a rear set of wheels relative to forward movement of the apparatus. The vehicle further includes the diverting section between the front set wheels and the rear set of wheels.

In yet another example aspect, the vehicle further includes a mobilizing section including a front set of wheels and a rear set of wheels relative to forward movement of the apparatus. The vehicle further includes the diverting section located rearward of the rear set of wheels.

In yet another example aspect, a method of clearing an accumulation of matter from a surface using a first apparatus is provided. The first apparatus includes a collecting section, a casting section, and a shifting section. The collecting section includes a blade and in matter communication with the casting section. The method including the steps of collecting matter by moving the blade in proximity with a surface, casting matter channeled from the collecting section away from a surface, and shifting matter laterally of the apparatus.

In yet another example aspect, the method further includes the step of using a second apparatus where the second apparatus includes a collecting section, a casting section, and a shifting section, and where the collecting section includes a blade and in matter communication with the casting section. The method further includes the step of moving the first multi-functional apparatus and the second multi-functional apparatus over a surface along the direction of travel where the second apparatus is disposed at a delayed interval about the first apparatus and transversely offset about the first apparatus such that the second apparatus can repeat steps of collecting matter, casting matter, and shifting matter.

In yet another example aspect, the shifting section is at least one of a diverting section, a sweeping section, and an air blowing section. The diverting section includes an auxiliary blade oriented at an angle about an axis transverse to a direction of travel. The sweeping section includes a rotatable broom with bristles. The air blowing section is configured to blow air in a predetermined direction. The step of shifting matter laterally of the apparatus is at least one of diverting matter laterally of the apparatus by moving the auxiliary blade in greater proximity with a surface, rotating the broom so that the bristles strike matter on a surface, and directing air toward matter so as to move matter in the predetermined direction.

In yet another example aspect, the method further includes a plurality of shifting sections.

BRIEF DESCRIPTION OF THE DRAWINGS

These and other aspects are better understood when the following detailed description is read with reference to the accompanying drawings, in which:

FIG. 5A is a view of an annular base of an embodiment of a sealing element;

FIG. 5B is a view of shutter pieces of the sealing element;

FIG. 5C is a view of an annular actuator of the sealing element;

FIG. 5D is a view of the shutter pieces on the annular base forming an opening with a first predetermined area;

FIG. 5E is a view of one of the shutter pieces rotating about a pivot point;

FIG. 5F is a view of the shutter pieces on the annular base forming the opening with a second predetermined area;

FIGS. 11A-11C are schematic representations of a first method of using a drive engine and an auxiliary engine;

DETAILED DESCRIPTION

Figure 1:
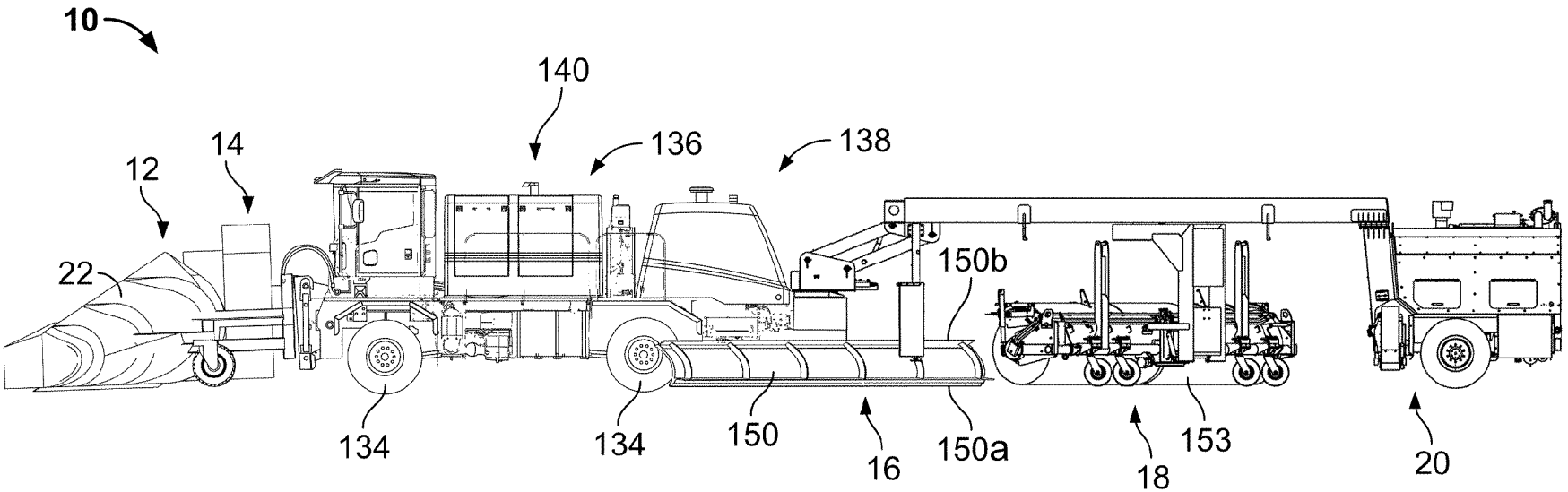
FIG. 1 is a side view of a multifunctional apparatus with a collecting section, a casting section, a diverting section, a sweeping section and an air blowing section.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, a multifunctional apparatus 10 for moving an accumulation of matter off a surface as explained herein is illustrated. The apparatus 10 may be a vehicle propelled by an engine, a motor or the like, such as a truck, a tractor, a dozer, a cart, etc., or may be a vehicular device that is not self-propelled, such as a trailer, requiring a separate source of power for movement. In other words, the apparatus 10 may be a self-propelled vehicle or may require the application of force by an animal, a human (such as through manual pushing or pulling), or the like. Alternatively, the apparatus 10 may become a part of a vehicle through retrofitting. Moreover, while the present embodiment is illustrated as an apparatus 10 for removing snow off of a surface that is exposed to accumulation of matter, the matter that is moved off the surface may also be ice, leaves, dust, debris, grass, clay, sand, or the like. Although the surface that is cleared of matter is generally a pavement such as a runway of an airport, a road, or a sidewalk, the apparatus 10 may have applicability regarding unpaved or natural surfaces as well.

The example multifunctional apparatus of FIG. 1 is embodied as a vehicle that includes a collecting section 12, a casting section 14, a diverting section 16, a sweeping section 18 and an air blowing section 20. The different sections of the vehicle perform designated functions that combine to clean the surface of matter to an acceptable degree. It may be also possible to embody the apparatus 10 in an alternative vehicle that includes a different combination of sections that are either discussed herein or known in the art. For example, the apparatus 10 may operate without the diverting section 16 or may be without the sweeping section 18 or the air blowing section 20.

Figure 2:
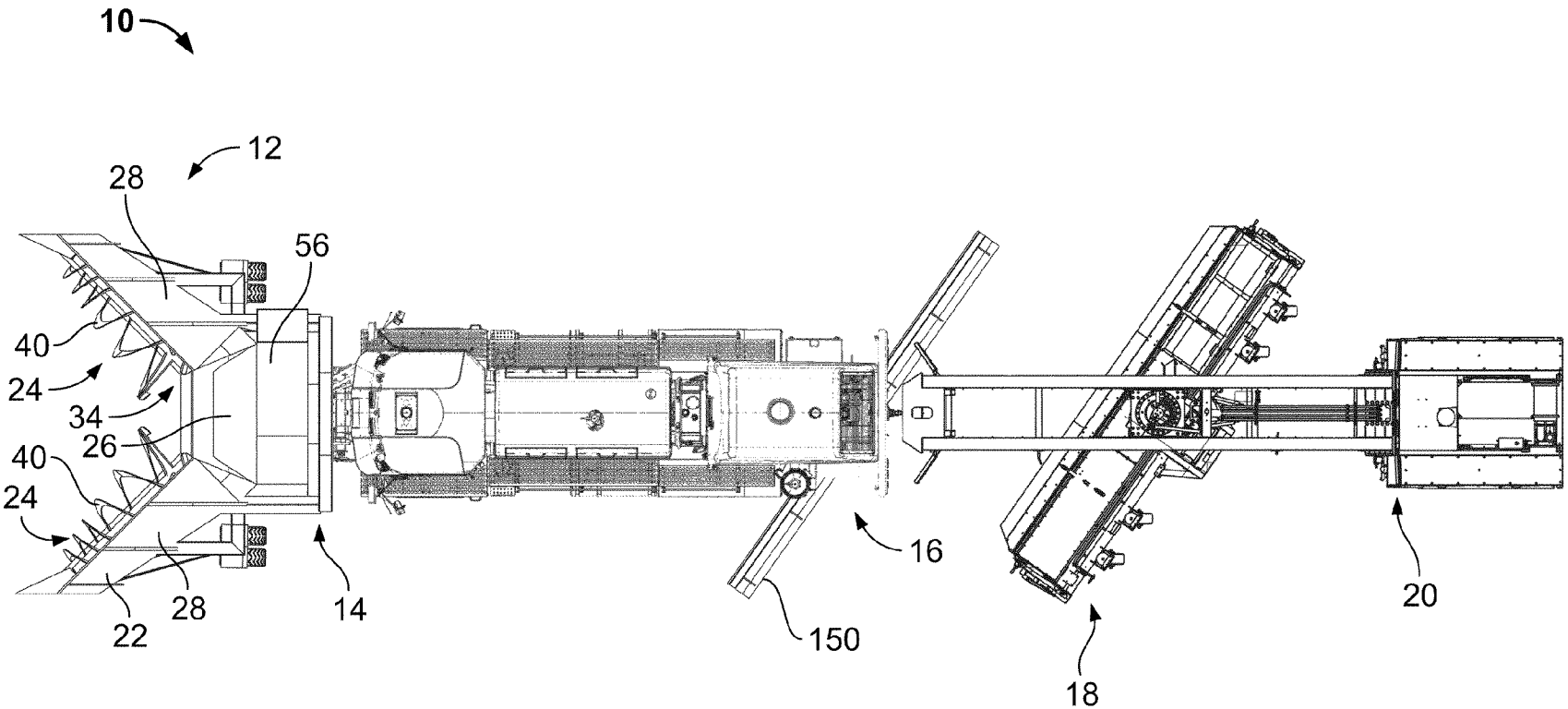
FIG. 2 is top view of the multifunctional apparatus.

The collecting section 12, shown in FIGS. 2-3, is configured to collect or gather matter that is accumulated on the surface. The collecting section 12 may include a blade 22 and one or more augers 24. The blade 22 collects matter as the blade 22 undergoes substantially forward movement, for example, due to the advancement of the apparatus 10. The blade 22 is substantially plate-like and is mounted such that a lower edge 23 is arranged in proximity with the surface that is cleaned. The blade 22 may be flat, curved or angular in overall shape or made up of a plurality of portions that can either be flat, curved, angular, etc. The blade 22 may be shaped such that, as the mass of matter meets a front of the blade 22, the matter is adapted to be directed toward a predetermined area of the blade upon movement of the apparatus 10. In the present embodiment, the blade 22 can substantially be divided into a central portion 26 and lateral portions 28 that are located forward relative to the central portion 26 and are oriented at an angle about the central portion 26. Outer ends of the lateral portions 28 may include a wedge-shaped block 30 configured to reduce resistance faced by the blade 22 when the front of the blade 22 encounters the mass of matter and to facilitate initial displacement of the mass toward the central portion 26. Moreover, the blade 22 may include angled surfaces along its peripheral edges 32 so as to direct matter toward an inner area 34 (FIG. 1) of the front of the blade 22. Furthermore, the central portion 26 and the lateral portions 28 may also include a curvature to direct matter to the inner area 34 of the blade 22 and, for example, may be concave on a front side when viewed along a vertical cross-section. The shape of the lateral portions 28 may thus be described substantially as semi-cones or semi-frustums of cones in the present embodiment.

The term "substantially" is used in this disclosure to encompass states that may vary from an exact state. For example, the term "substantially parallel" may refer to the positional relationship of two things that are not only exactly parallel but also near a parallel state when the overall relationship is considered.

As shown in FIGS. 2-4B, the collecting section 12 in the present embodiment may also include a pair of augers 24 located forwardly of the blade 22. The auger 24 may have a shaft 38 and one or more ribbons 40. The augers 24 may be partially housed within the blade 22 with the curvature of the blade 22 enclosing the ribbons 40 (FIG. 2). The present embodiment is arranged with three ribbons 40 that are arranged at different angular positions from one another, for example, displaced by 120 degrees. Each ribbon 40 may be helically arranged about the shaft 38 so as to substantially form a cylinder, a cone or a section of a cone, as shown in FIG. 4A, such as a frustum of a cone. Such an arrangement may be made possible by connecting the ribbon 40 to the shaft using a set of spokes 44. While FIGS. 4A-4B do not show all of the spokes 44 for clarity of illustration, the spokes 44 are provided at multiple locations along the shaft 38 to provide structural support of the ribbon 40. In case of a conical arrangement of the ribbon 40 about the shaft 38, the ribbon 40 may be arranged to vary along the shaft 38 in radial distance from the shaft 38 and, for example, may gradually increase in radius in one direction along the shaft 38. Moreover, the ribbons 40 may be arranged such that a base 46 (FIG. 4A) of the cone is located near the central portion 26 of the blade such that a vertex of the cone is facing away from the central portion 26 of the blade 22. Furthermore, the ribbons 40 may be arranged such that a pitch 48 between revolutions of the ribbon 40 increases toward the base 46 of each cone (FIG. 4A) although the pitch 48 may also be constant along the shaft 38. Additionally, the pair of ribbons 40 may be arranged in a symmetrical fashion about the central portion 26 of the blade 22.

In the present disclosure, the term "cone" is used to refer to the shape formed by the ribbons 40 which are cone-like but may encompass shapes that differ in some respects from a conventional cone shape. For example, the term may also refer to frustums of cones or cylinders in the present disclosure.

Figure 3A:
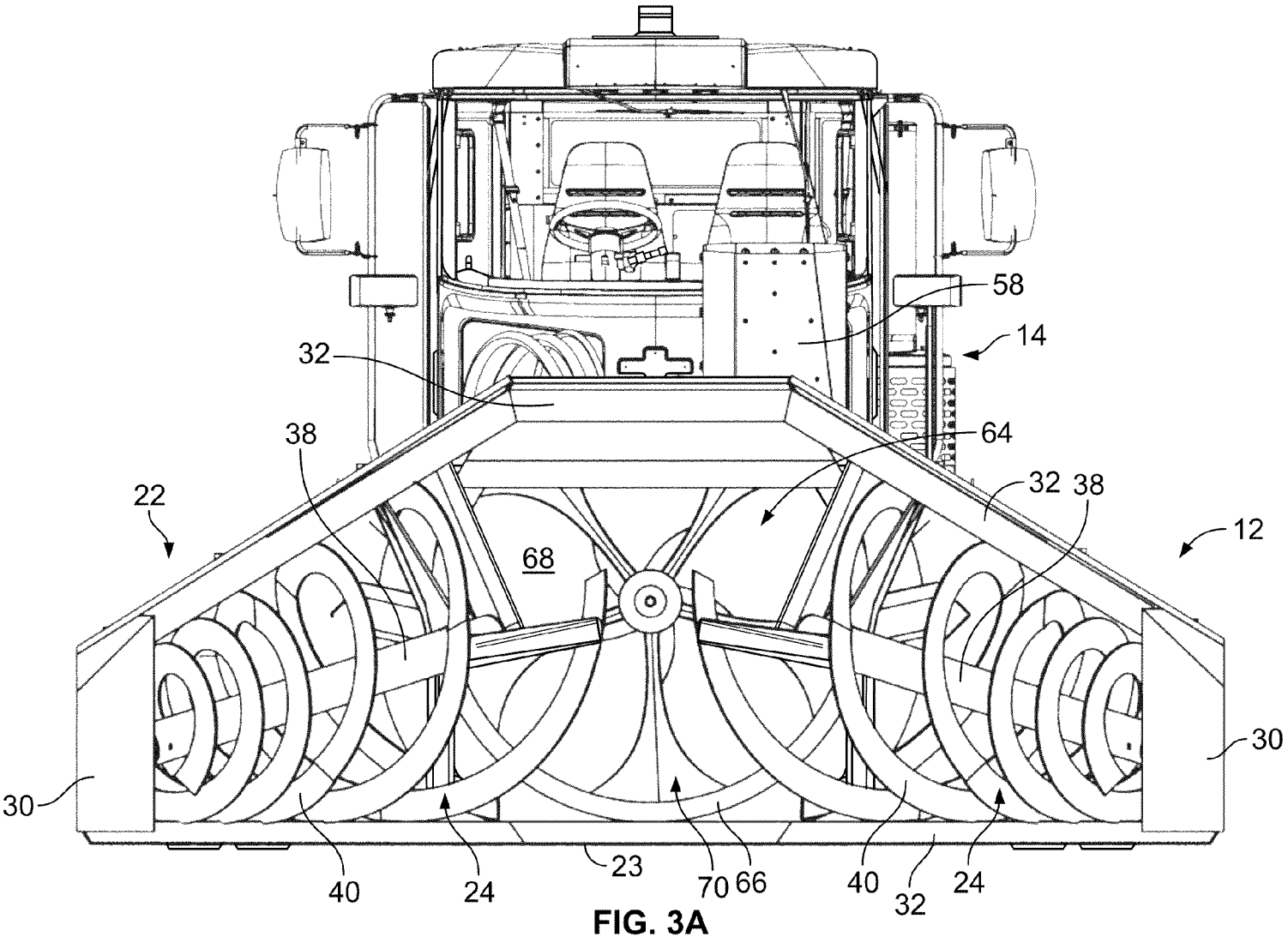
FIG. 3A is a front view of the multifunctional apparatus showing augers, a blade of the collecting section and a volute extension.
Figure 3B:
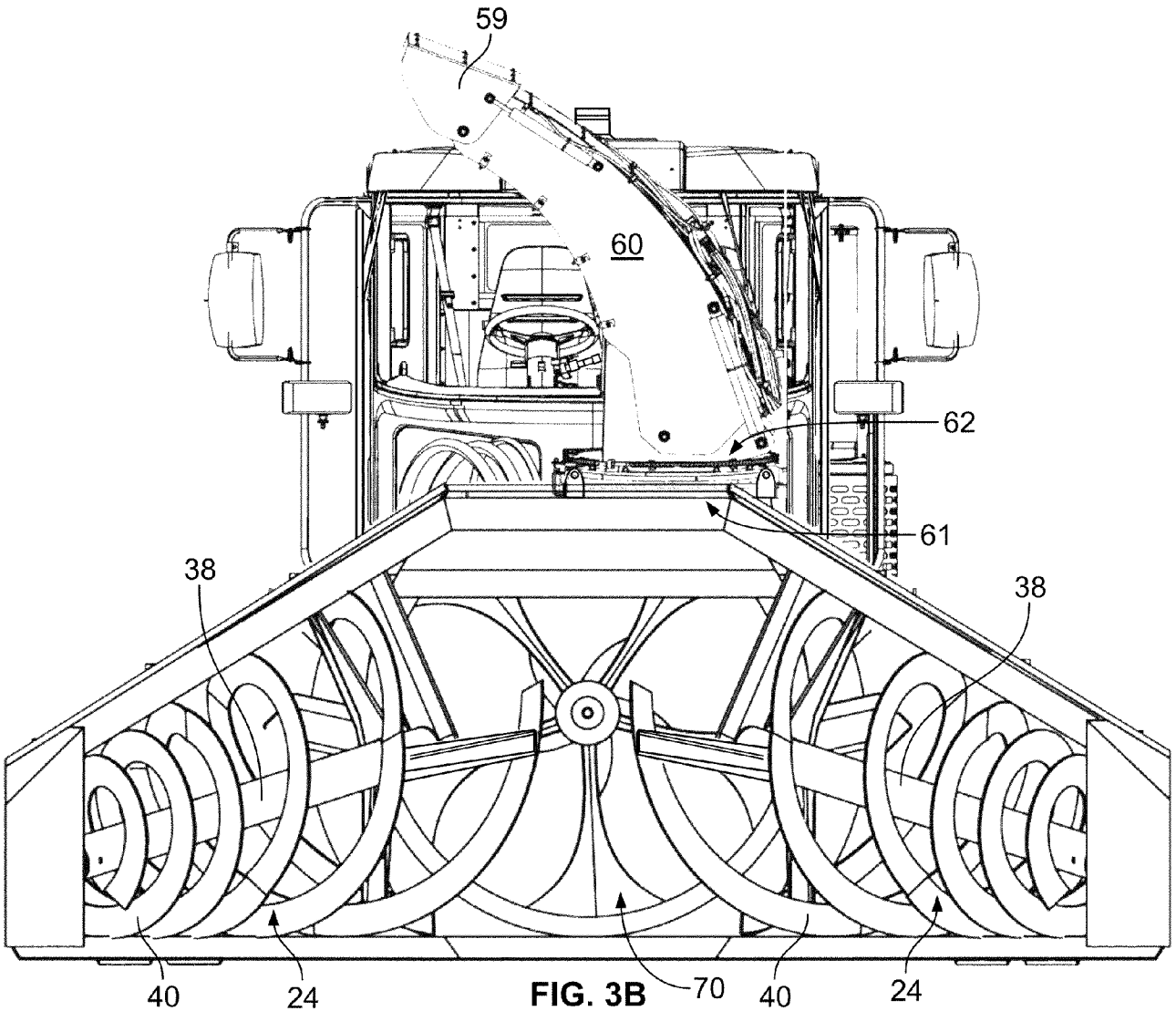
FIG. 3B is a front view of the multifunctional apparatus showing a casting chute turned in one direction.
Figure 3C:
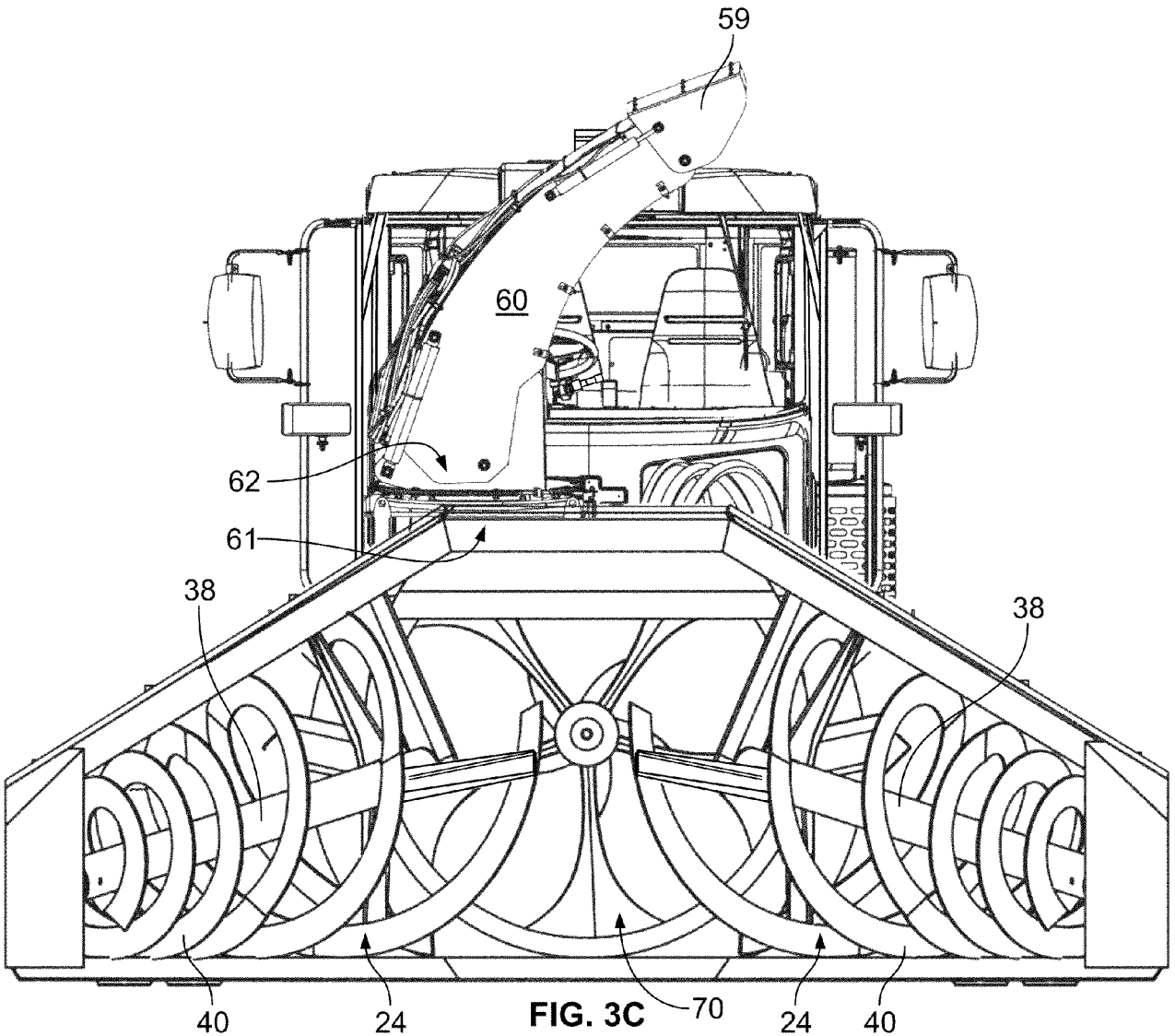
FIG. 3C is a front view of the multifunctional apparatus showing the casting chute turned in another direction.

Each shaft 38 of the auger 24 is coupled to a rotational power source (not shown) to undergo rotation about an axis 42. In the present embodiment, the shafts 38 form an acute angle with a direction of travel of the apparatus so as to form an acute angle about a transverse axis (FIG. 4A). Moreover, the shafts 38 are oriented at an angle relative to the ground such that a side 52 of the cone extending from the vertex to the base of the cone is substantially parallel to the ground although the shafts 38 may be oriented at different angles, for example, in a coaxial fashion, or may not be arranged so as to mirror one another. The blade 22 is dimensioned and shaped such that the ribbons 40 substantially fit within the semi-cones or the semi-frustums of cones. As a result, the central portion 26 of the blade 22, where the bases 46 of the cones are located, may be taller than the lateral portions 28 of the blade 22 (FIG. 3). Such an arrangement of the augers 24 and the blade 22 allows the ribbon 40 to engage substantially all of the mass of matter that is collected by the blade 22. Moreover, the speed of the augers 24 may be adjustable either separately or together and the augers 24 may undergo rotation in either clockwise or counterclockwise directions.

As shown in FIGS. 1-3F, the central portion 26 of the collecting section 12 may include an outlet that leads to the casting section 14. The casting section 14 is configured to cast, expel or eject matter away from the surface that is cleaned and may include a volute 56 and a volute extension 58. Additionally, it may be beneficial under certain conditions of use to have the ability to change the casting direction. For this purpose, a casting chute 60, which is well known in the art, can be placed in line with the volute extension 58.

Figure 3D:
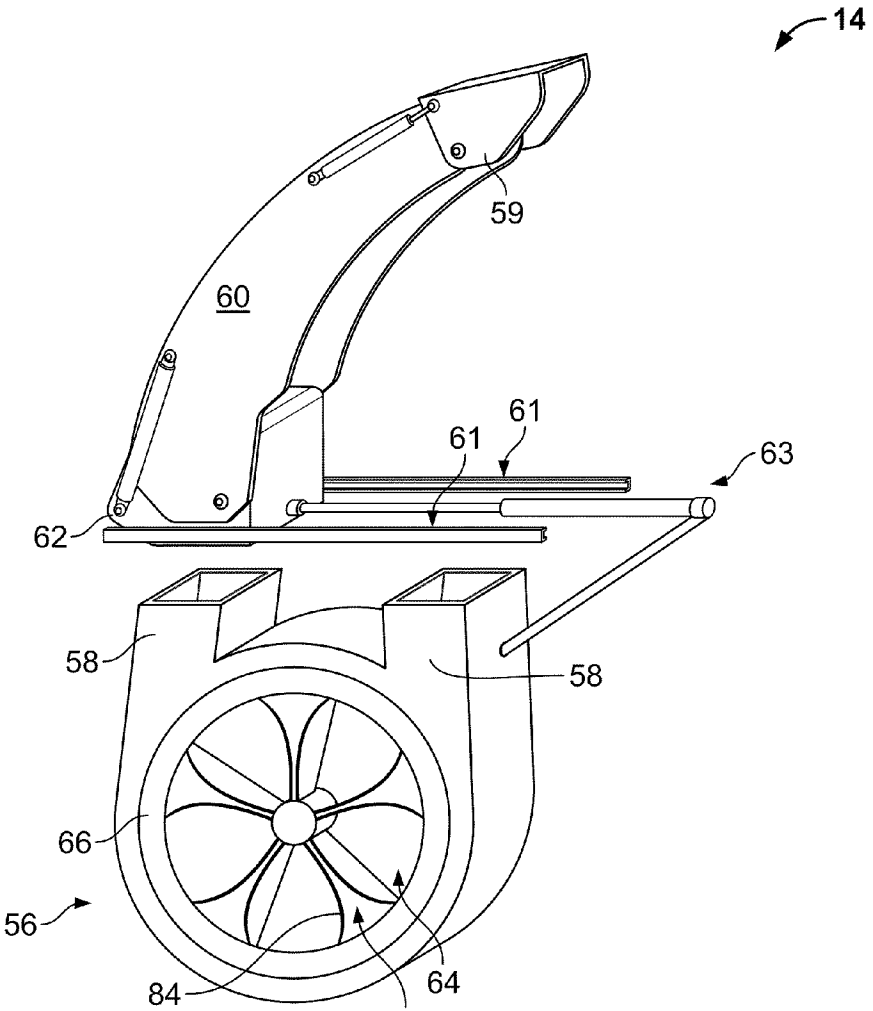
FIG. 3D is a perspective schematic view of a first embodiment of the casting section in an isolated state.
Figure 3F:
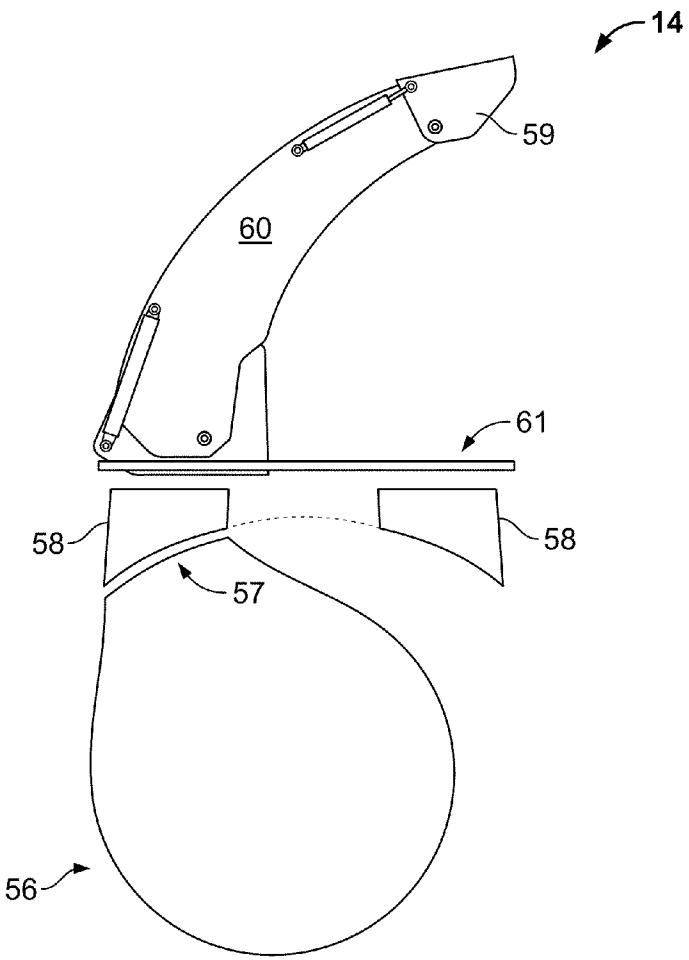
FIG. 3F is a front schematic view of a second embodiment of the casting section in an isolated state.
Figure 3E:
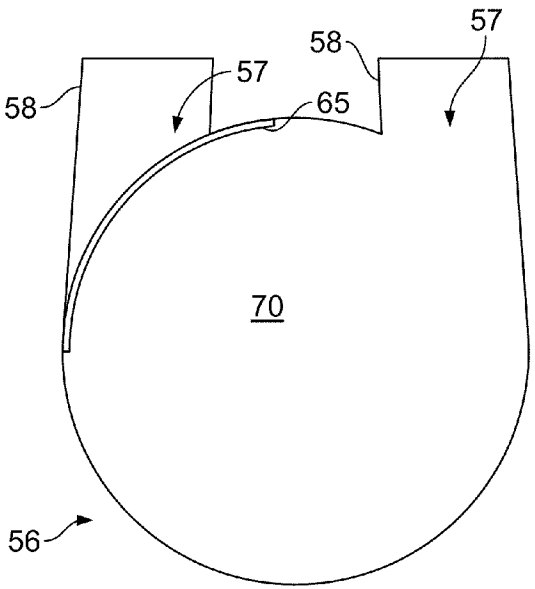
FIG. 3E is a front schematic view of an interior of a volute in the first embodiment of the casting section.
Figure 4A:
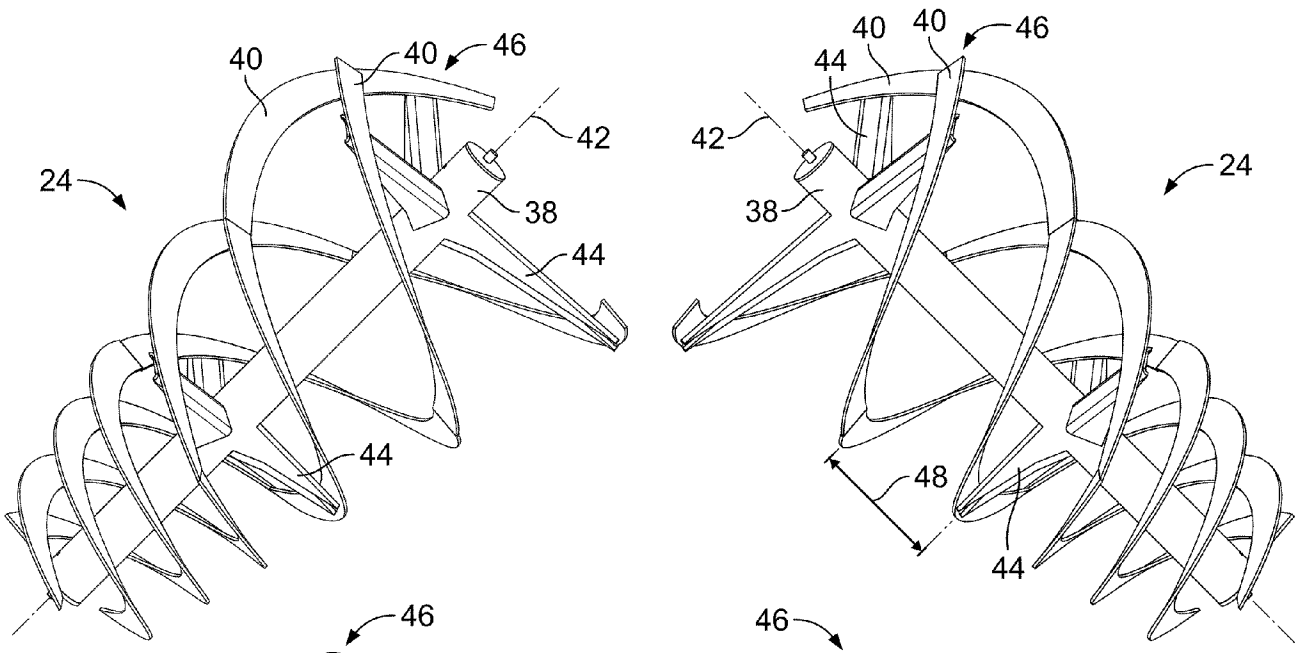
FIG. 4A is a top view of the augers in an isolated state.
Figure 4B:
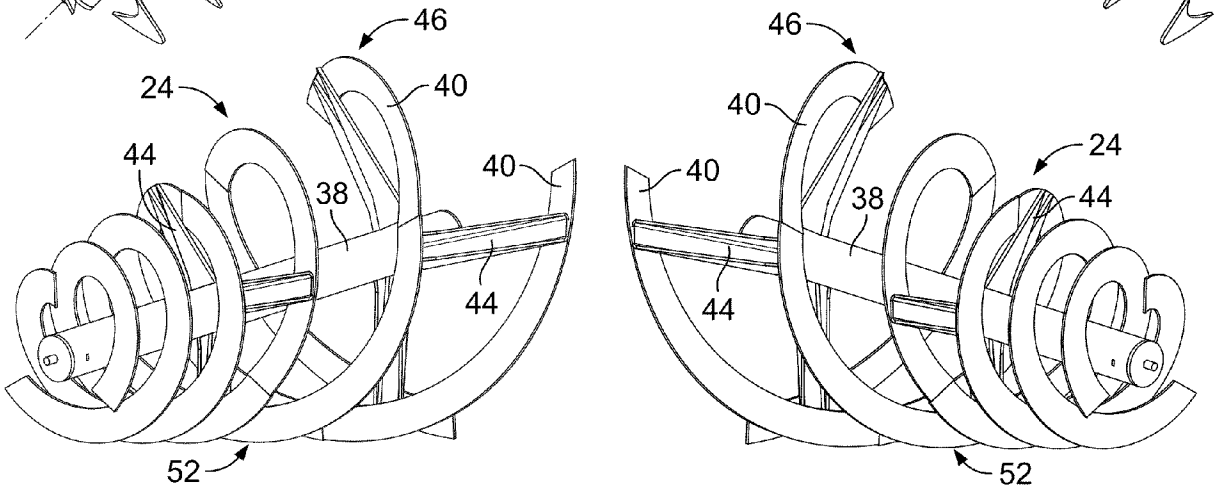
FIG. 4B is a front view of the augers in an isolated state.

As shown in FIGS. 3D-3F, the volute 56 may include a chamber 70 and an inlet end 64 that is in communication with the outlet of the collecting section 12. The volute 56 houses a rotor 84 with blades that are rotatable about a central, primary axis 88 (FIGS. 6A-8). As will be described below, there are a number of embodiments for the rotor 84.

The chamber 70 may be a substantially cylindrical space arranged in a horizontal manner. The inlet end 64 of the volute 56 may include a sealing element 66 with an opening 68 of a predetermined area (FIGS. 3A and 3D). The sealing element 66 prevents matter in the chamber 70 from escaping the chamber 70 and returning to the collecting section 12 during operation of the rotor 84. The predetermined area of the opening 68 may be constant such that the sealing element 66 is an annular plate. Alternatively, as shown in FIGS. 5A-5F, the sealing element 66 may include a mechanism for variably adjusting the predetermined area. For example, the sealing element 66 may include an annular base 72, an annular actuator 74 and a plurality of shutter pieces 76 which are arched. The annular base 72 may include a plurality of pivot points 78 which correspond in number to the shutter pieces 76 such that the shutter pieces 76 can rotate about the pivot points 78 (FIG. 5E). The shutter pieces 76 are arranged to extend along the periphery of the annular base 72 and respectively include an actuated point 80 (FIG. 5D). The actuator 74 includes a number of slots 82 that the actuated points 80 are configured to fit within and travel along. Thus, when the actuator 74 is rotated with respect to the annular base 72, the shutter pieces 76 rotate about the pivot points 78 toward or away from a center of the sealing element 66 such that the predetermined area of the opening 68 may vary depending on the positions of the shutter pieces as shown in FIGS. 5D and 5F. Thus, such adjustability of the predetermined area of the opening 68 allows the amount of matter that can enter the chamber 70 to be controlled.

Figure 6C:
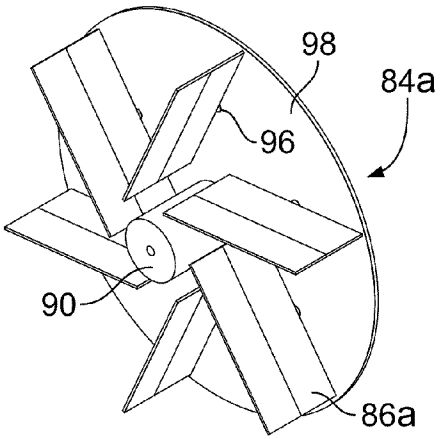
FIG. 6A-6C are views of a first embodiment of the rotor with blades in radial and non-radial positions.
Figure 6C:
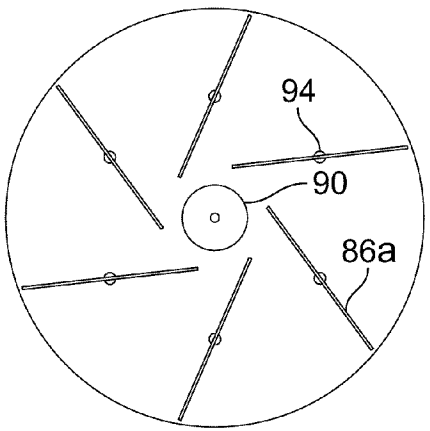
Figure 6B:
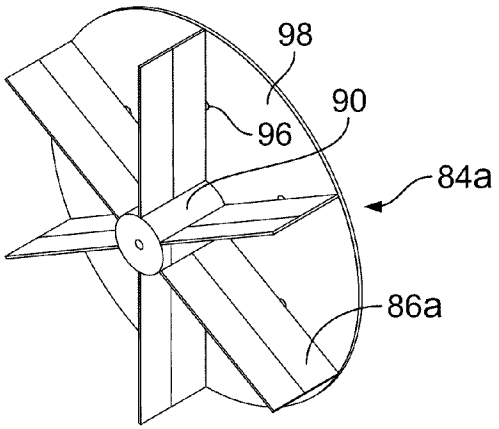
Figure 6B:
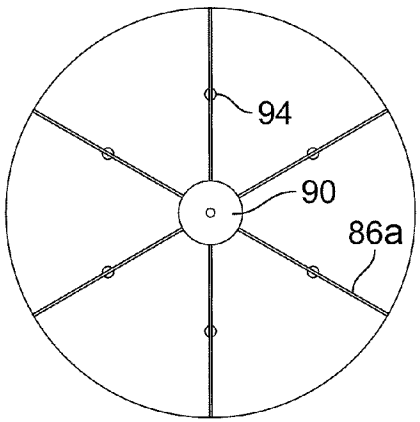
Figure 6A:
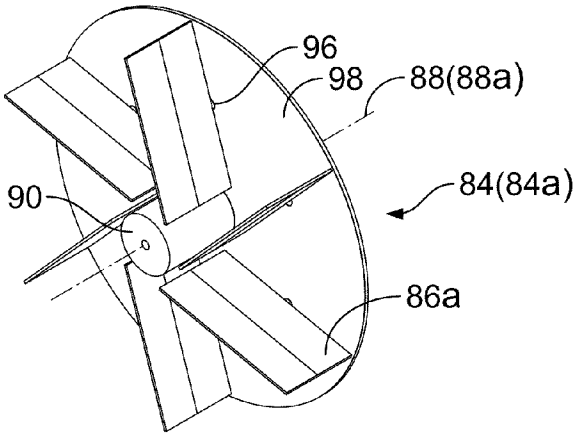
Figure 6A:
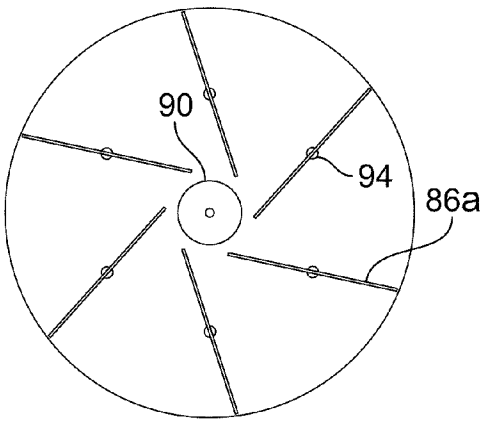

FIGS. 6A-6C show a first embodiment of the rotor 84*a* isolated from the volute 56. A shaft 90 of the rotor 84*a* extends along the primary axis 88*a* and is coupled to a power source (not shown) to rotate the rotor 84*a* in the chamber. The rotor 84*a* may be rotatable in both clockwise and counterclockwise directions. The blades 86*a* of the rotor 84*a*, the number of which may vary, are oriented substantially parallel to the primary axis 88*a* and extend substantially from a central area to a perimeter of the chamber. The blades 86*a* of the rotor 84*a* are configured to cast matter entering the chamber 70 from the outlet of the collecting section 12 to radial openings 57 on the chamber. Each blade 86*a* can also be rotatably adjusted about a secondary axis 94 that is located radially away from the central, primary axis 88*a*. The secondary axis 94 is parallel to the primary axis 88*a* and lies in the plane of each blade 86*a*. Thus, the blades 86*a* can be rotatably adjusted in clockwise and counterclockwise directions so that the blades 86*a* can assume radial orientations (FIG. 6B) and various non-radial orientations (FIGS. 6A and 6C). Each blade 86*a* may include a rod that extends through a hole 96 of a rear plate 98. The rod can be coupled to a gear (not shown) and a gear system (not shown) may couple the individual gears together so that the adjustment of the blades 86*a* about the secondary axis can occur simultaneously.

Figure 7C:
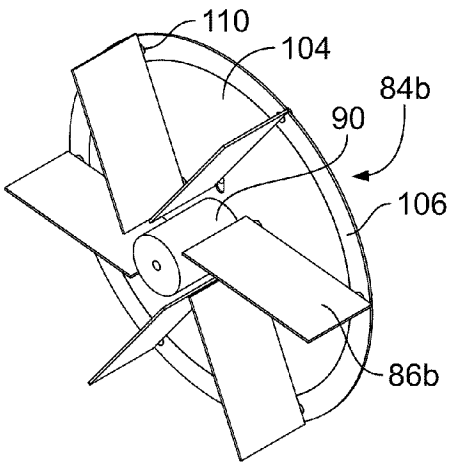
FIG. 7A-7C are views of a second embodiment of the rotor with blades in radial and non-radial positions.
Figure 7C:
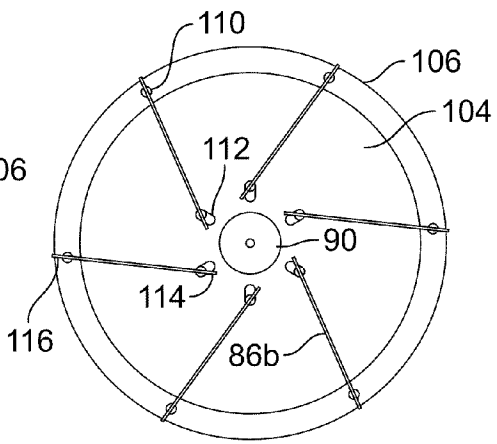
Figure 7B:
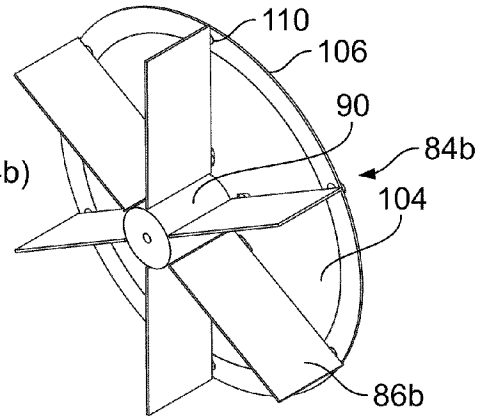
Figure 7B:
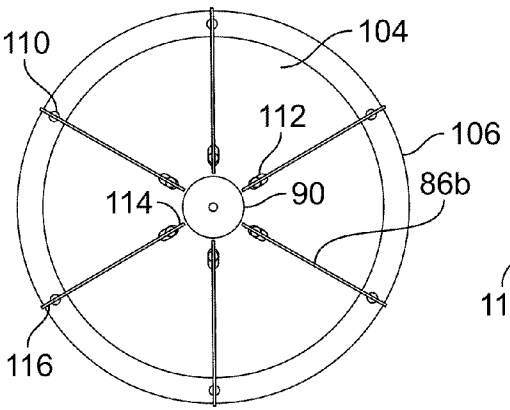
Figure 7A:
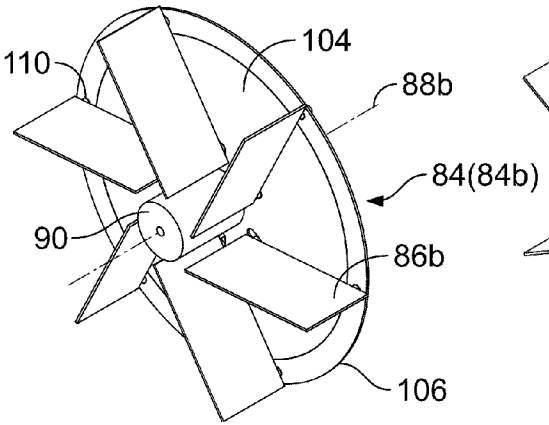
Figure 7A:
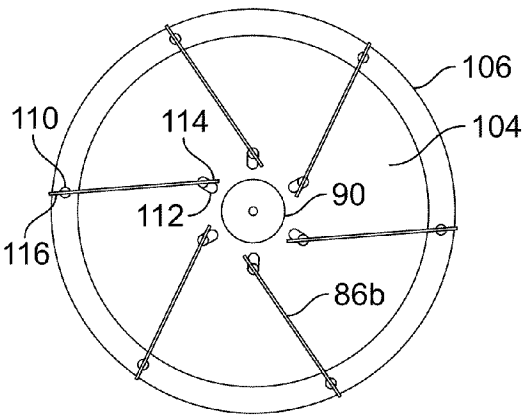

A second embodiment of the rotor 84*b*, shown in FIGS. 7A-7C provides an alternative mechanism by which the blades 86*b* of the rotor 84*b* can assume radial positions (FIG. 7B) and various other non-radial positions (FIGS. 7A and 7C). The rotor 84*b* includes an inner plate 104 and an outer plate 106 that are configured concentrically about a central, primary axis 88*b*. The inner plate 104 and the outer plate 106 are rotatable with respect to one another. In other words, the outer plate 106 may be stationary while the inner plate 104 is rotatable about the outer plate 106 or the inner plate 104 may be stationary and the outer plate 106 may be rotatable about the inner plate 104. The outer plate 106 includes a predetermined number of holes 110 along its perimeter. The inner plate 104 includes the same number of slots 112 in the central area around the primary axis 88*b*. The blades 86*b* substantially extend from a central area to a perimeter of the chamber 70 and each blade 86*b* includes an inner end 114 and an outer end 116. The inner end 114 may include an inner rod that extends parallel to the primary axis 88*b* through the slot 112 of the inner plate 104 and the outer end may include an outer rod that extends parallel to the primary axis 88*b* through the hole 110 of the outer plate 106. The outer rod is able to rotate within the hole 110 while the inner rod can slidingly move along the slot 112. Such coupling of the blades 86*b* with the inner and outer plates 104, 106 allows the blades 86*b* to assume radial orientations (FIG. 7B) and various non-radial orientations (FIGS. 7A and 7C) depending on the rotational adjustment of the inner plate 104 with respect to the outer plate 106. For example, as the inner plate 104 is rotated clockwise relative to the outer plate 106, the inner rods slide radially outward within the slots 112 and the blades 86*b* become slanted away from the radial orientations or oriented as shown in FIG. 7A (i.e., forward curved). As the inner plate 104 is rotated counterclockwise relative to the outer plate 106 from the position in FIG. 7A, the inner rods slide radially inward within the slots 112 and the blades 86*b* can return to radial orientations (FIG. 7B). As the inner plate 104 is rotated counterclockwise further relative to the outer plate 106, the inner rods slide radially outward within the slots 112 and the blades 86*b* become slanted or oriented as shown in FIG. 7B (i.e., backward curved).

It should be noted that some of the holes and slots for the blades have been omitted for clarity of illustration in FIGS. 6A-7C. In operation, the blades may be subjected to substantial forces created by high rotational speeds and may need to further overcome the presence of matter within the chamber 70 under such conditions. Therefore, features for structurally reinforcing the blades, such as additional rods, pins or the like, may be included in such embodiments. Moreover, while the blades 86*a*, 86*b* in FIGS. 6A-7C are shown to be substantially flat, their shapes may be varied, for example, to be curved or to form a shape akin to a cup or a scoop for improved retention of matter during rotation of the rotor 84*a*, 84*b*.

Figure 8:
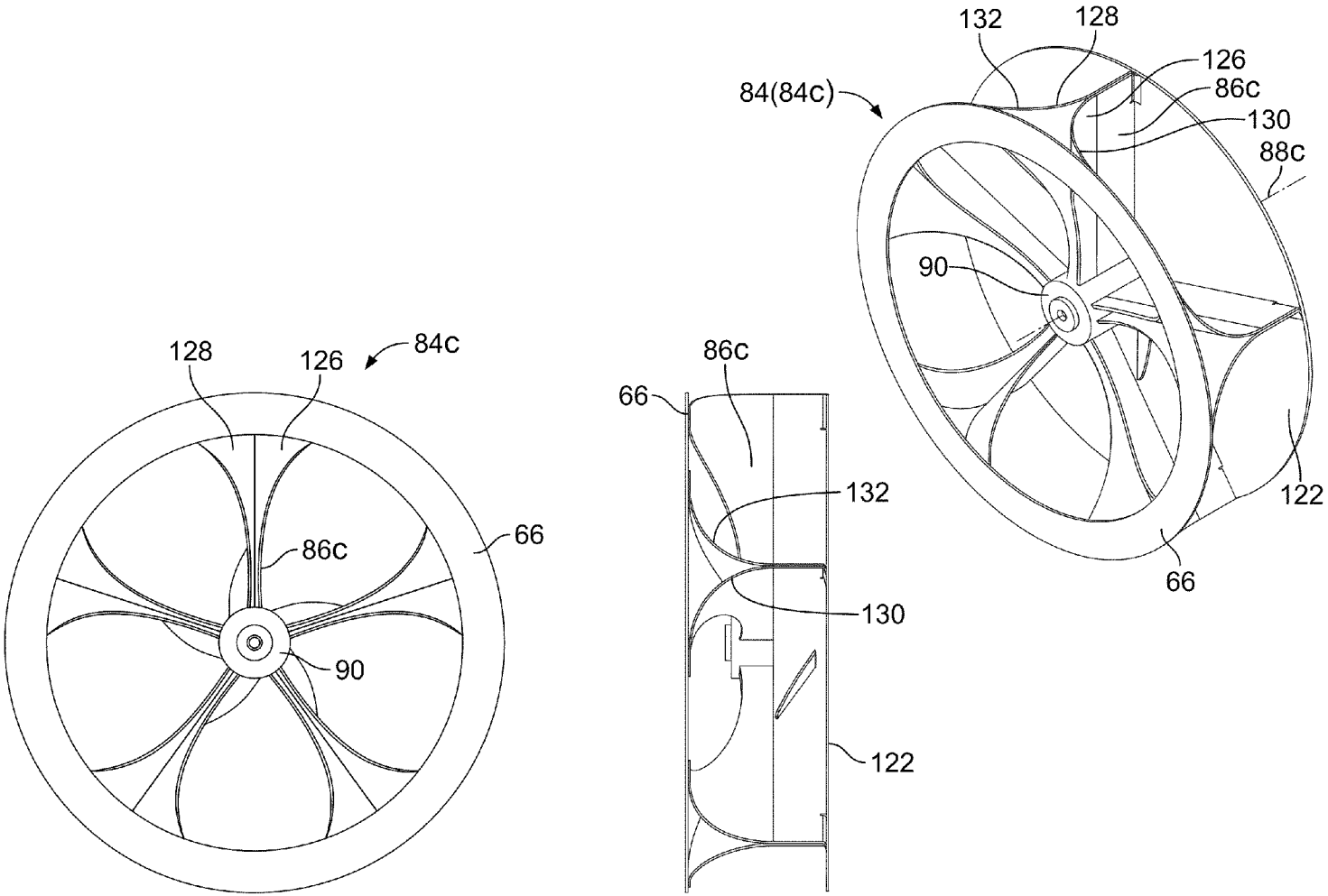
FIG. 8 is a view of a third embodiment of the rotor with blades having curved portions.

FIG. 8 shows a third embodiment of the rotor 84*c* with an annular ring as the sealing element 66. The sealing element 66 may thus be part of the rotor 84 or part of the volute 56. The rotor 84*c* may include blades 86*c* with curved portions. Moreover, the blades 86*c* extend from the central area to the perimeter of the chamber 70 and extend partially along a plane between the sealing element 66 and a rear plate 122 where the plane is parallel to the primary axis 88*c*. Each blade 86*c* may be made of a first sheet 126 and a second sheet 128 that may abut or be affixed to one another along a majority of their surfaces. The first sheet 126 may include a first curved portion 130 at a corner and the second sheet 128 may include a second curved portion 132 at the corner. Each curved portion flares away from the other curved portion near the sealing element 66 such that the curved portion transitions between the blade 86*c* and the sealing element 66. The first curved portion 130 may transition from the plane to the sealing element 66 in a first rotational direction while the second curved portion 132 may transition from the plane to the sealing element 66 in a second, opposite rotational direction. The blades 86*c* thus become wider near the sealing element 66 and are flared in either rotational direction.

As shown in FIGS. 3D-3F, the volute 56 may include radial openings 57 such that the centrifugal force generated by the rotor 84 can expel matter out of the chamber 70 and through the radial openings 57. The radial openings 57 may be lead to the tube-like volute extension 58 which can guide the direction in which the matter is expelled. The volute 56 may be configured such that the orientation of the volute extension 58 and the radial openings 57 can be altered in order to change the direction in which the matter is expelled. For example, the volute 56 may include multiple radial openings 57 that can be selectively opened or closed, for example, through movement of a cover 65 along the perimeter of the chamber 70 such that only one radial opening 57 at a desired perimeter location is open for casting of matter (FIG. 3E). The rotational direction of the rotor 84 may be changed between clockwise or counterclockwise directions to control parameters such as casting effectiveness or casting distance and the location of the radial opening 57 may need to accommodate such changes in operation conditions. In an alternative embodiment, the volute 56 may have one radial opening 57 and the volute 56 itself, or a component within the volute 56, may be rotatable about a primary axis 88 to align the radial opening 57 with one of the volute extensions 58 (FIG. 3F). Moreover, as shown in FIGS. 3B-3C, the casting chute 60 may be adjustable to allow alignment with the volute extension 58 such that the direction in which the matter is expelled can be changed even further or controlled even more precisely. The casting chute 60 may be extendable, rotatable or may have an adjustable flap 59 at an upper end to guide the expelled matter more precisely. The lower end 62 of the casting chute 60 may be movable in order to adjust to changes in the orientation of the volute extension 58 and facilitate alignment. For example, the lower end 62 of the casting chute 60 may be placed above a set of rails 61 along which the lower end can slidingly move. The lower end 62 of the casting chute 60 may be moved about the rails 61 using a movement generating means 63 which can be various means known in the art such as a motor, a hydraulic pump or the like. Alternatively, the lower end 62 may be moved manually and secured using means known in the art such as screws, bolts-nuts or the like. Moreover, the lower end 62 of the casting chute 60 may be rotatable about a vertical axis. If the lower end 62 of the casting chute 60 is on a left hand side of an operator driving the apparatus 10 (FIG. 3B), the casting chute 60 may be oriented such that the adjustable flap 59 is directed toward a right hand side of the apparatus 10. If the lower end 62 of the casting chute 60 is on a right had side of the operator (FIG. 3C), the adjustable flap 59 may be directed toward a left hand side of the apparatus 10. Alternatively, the lower end 62 of the casting chute 60 may be configured such that the lower end 62 is rotatable about a vertical axis but not laterally movable, for example, with the lower end 62 located centrally about the apparatus 10.

The example apparatus 10 may be mobilized by wheels 134 coupled to a power source, such as a drive engine 138 that may be located on a mobilizing section 136 between the collecting section 12 and the sweeping section 18. The example apparatus 10 may further include an auxiliary engine 140. In one embodiment, shown in FIGS. 11A-11C, the drive engine 138 may be used exclusively to power the movement of the apparatus 10 while the auxiliary engine 140 is used exclusively to power the rotation of the augers 24 of the collecting section 12 and the rotor 84 of the casting section 14. The power generated by the drive engine 138 may be transmitted to a drive transmission 142 that is coupled to the wheels (FIG. 11A). Meanwhile, the auxiliary engine 140 powers a drop box 144 which is coupled to a gear box 146 which may drive the rotor 84 of the casting section 14 and the augers 24 of the collecting section 12 simultaneously (FIG. 11B). Alternatively, the auxiliary engine 140 may power the augers 24 of the collecting section 12 independently of the rotor 84 of the casting section 14 by coupling a hydraulic pump/motor 148 to the augers 24 and coupling a drop box 144 to the rotor 84 (FIG. 11C). Independent control of the augers 24 from the rotor 84 allows the speed of the augers 24 in response to be adapted depending on the amount of accumulation on the surface. For example, if the rotor 84 of the casting section 14 is not able to keep up with the flow rate at which the augers 24 feed the chamber, it may be necessary to slow down the speed of the augers 24. Moreover, if there is matter stuck in the augers 24, the ability to operate the augers 24 independently, and possibly rotate them in reverse directions, without rotating the rotor may also be helpful.

Figure 12C:
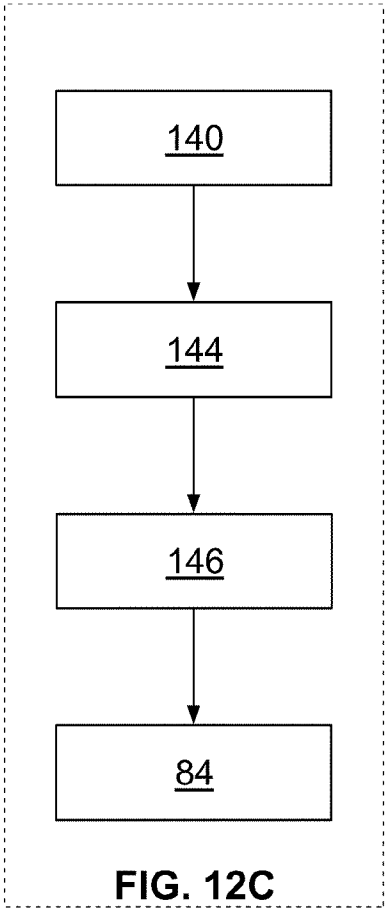
FIGS. 12A-12C are schematic representations of a second method of using the drive engine and the auxiliary engine.
Figure 12B:
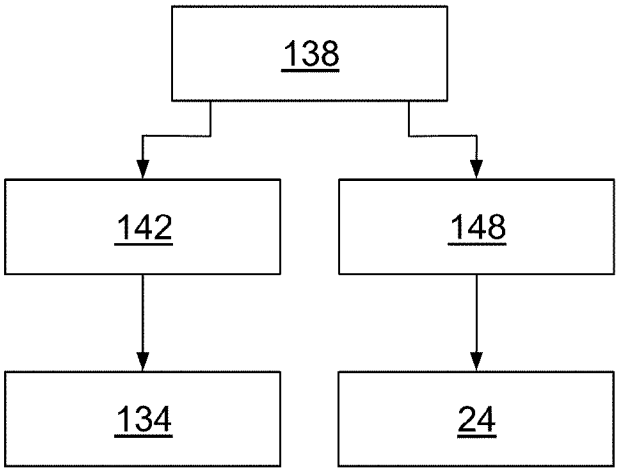
Figure 12A:
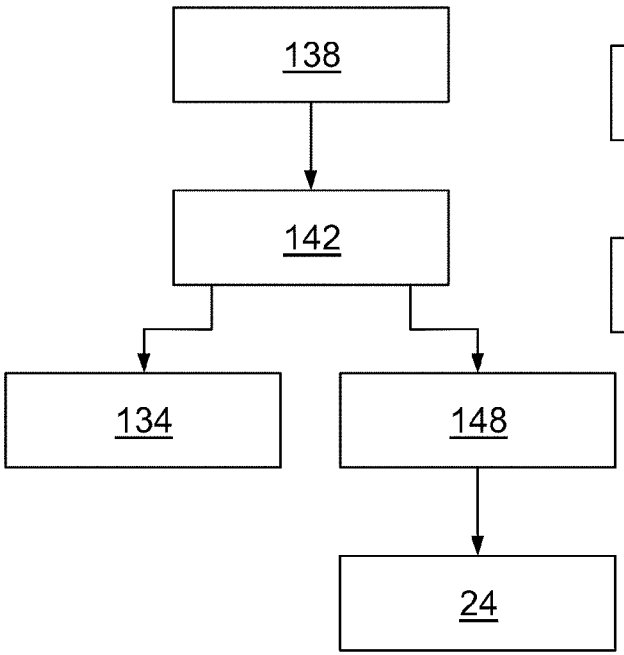

FIGS. 12A-12C illustrates an alternative manner of using the drive engine 138 and the auxiliary engine 140. In FIG. 12A, the augers 24 may be driven by the drive engine 138 by coupling the hydraulic pump 148 to the drive transmission 142. Alternatively, as shown in FIG. 12B, it may also be possible to drive the augers 24 by coupling the hydraulic pump 148 to the drive engine 138 through a power take-off shaft. In this embodiment, an operator or a controller can monitor the performance of the augers 24 to determine whether or not more power is needed for the augers 24 and can correspondingly adjust the ratio between the speed of the wheels 134 and the speed of the augers 24. For example, the drive transmission 142 can be controlled to increase the driving speed of the apparatus 10 even if the overall revolution-per-minute (rpm) of the drive engine is low. Meanwhile, the auxiliary engine 140 is used to solely drive the rotor 84 of the casting section 14. Coupling the augers 24 to the drive engine 138 permits more power to be directed to the rotor 84 of the casting section 14. Also, additional power from the drive engine 138, which may not be used to full capacity, is utilized such that the overall efficiency of the system is increased.

Figure 9:
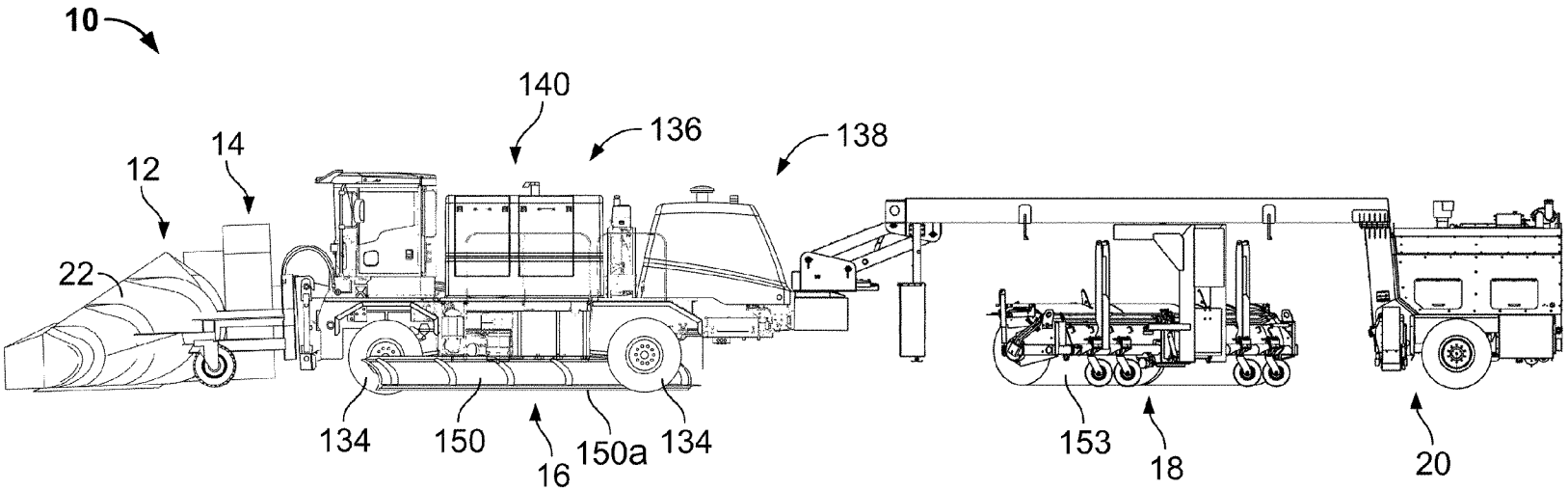
FIGS. 9 and 10 are respectively a side view and a top view of the multifunctional apparatus with a diverting section in an alternative position.

As described above, the collecting section 12 and the casting section 14 may combine to remove the bulk of matter encountered by the apparatus 10. Meanwhile, the diverting section 16, the sweeping section 18 and the air blowing section 20 are provided to remove any remnant of the matter from the surface. Each of the diverting section 16, the sweeping 18 and the air blowing section 20 may be considered as a shifting section that is configured to shift the remnant of the matter laterally. While FIGS. 1 and 9 illustrate apparatus 10 with the three types of shifting sections (i.e., the diverting section 16, the sweeping section 18 and the air blowing section 20), the apparatus 10 can be embodied to have fewer or more shifting sections. For example, the apparatus 10 may simply include the diverting section 16 or may include devices known in the art as a shifting section in addition to the shifting sections illustrated. Also, it may be possible to embody an apparatus 10 with multiple shifting sections of the same type.

Figure 10:
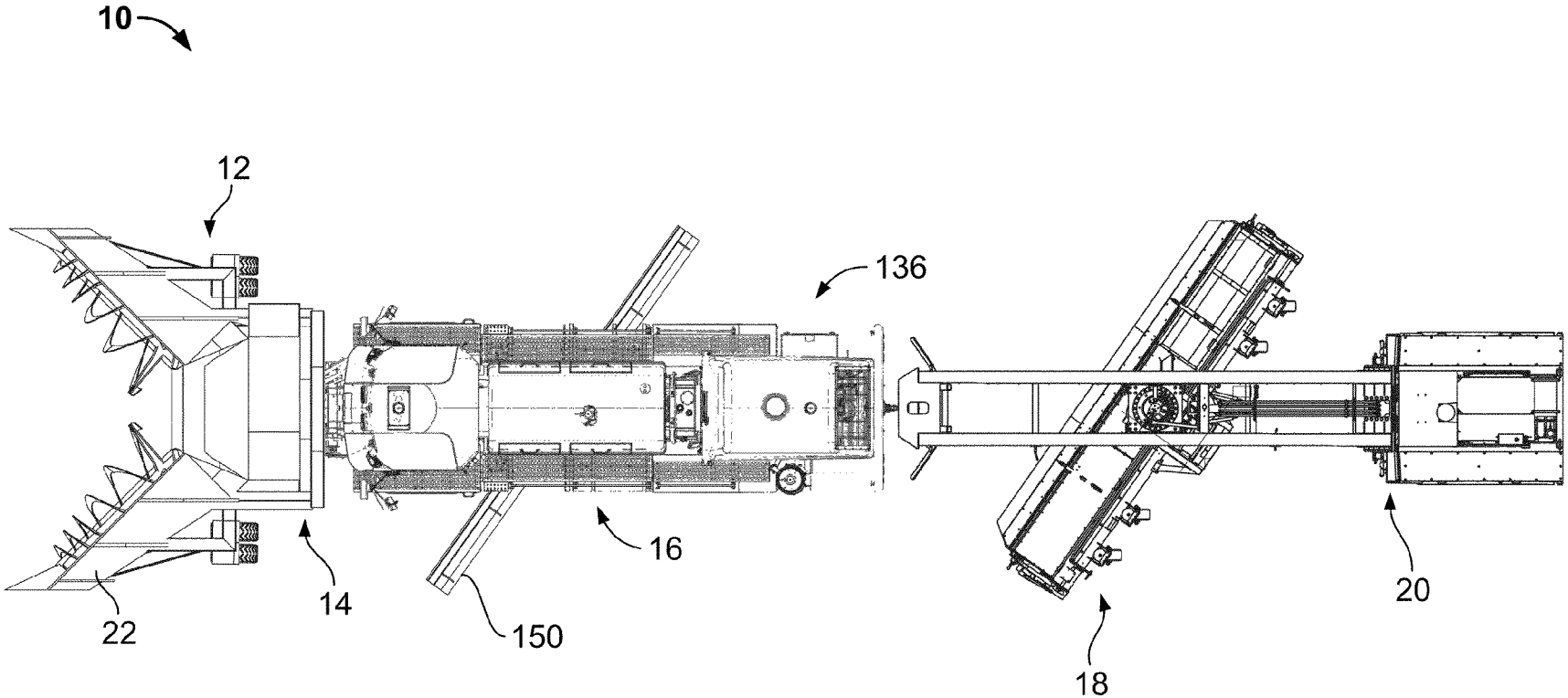

The diverting section 16 may be embodied as an auxiliary blade 150 that is configured to scrape the matter off the surface. The auxiliary blade 150 may thus be a plate-like component similar to the blade 22 of the collecting section 12 and may include a vertically curved cross-section allowing matter to accumulate in front of the auxiliary blade 150. Thus, a lower edge 150*a* (FIG. 1) of the auxiliary blade 150 may be arranged in greater proximity to the surface than a lower edge 23 of the blade 22 of the collecting section 12 so that the remnants of matter that were not gathered by the collecting section 12 can be scraped off. Moreover, the auxiliary blade 150 may be tilted forward such that an upper edge 150*b* (FIG. 1) is forward of the lower edge 150*a*. Furthermore, the orientation of the auxiliary blade 150 may be at an acute angle with a transverse axis so that the scraped-off matter can be shifted laterally to a side of the apparatus 10 and can be processed by a separate apparatus that trails the apparatus 10 along an adjacent cleaning path or line as described below. The diverting section 16 may be mounted at different locations rearward of the collecting section 12 and may be, for example, rearward of the wheels 134 (FIG. 1) or between the wheels 134 (FIGS. 9-10) of the mobilizing section. When mounted between a front set of wheels and a rear set of wheels, the auxiliary blade 150 may be able to encounter matter on the surface with greater downward force such that the matter, which may have been compacted by the passage of the blade 22 of the collecting section 12, can be removed from the surface more effectively. It may be possible to move the diverting section 16 to a different location, such as rearward of the air blowing section 20, or to provide one or more additional diverting section(s) 16. Moreover, the apparatus 10 may be embodied without the diverting section 16.

The sweeping section 18 may be located rearward of the casting section 14 or the diverting section 16 and is configured to further remove matter that remains on the surface. The sweeping section 18 may include one or more broom(s) 153 that include a set of bristles and rotate such that the bristles sweep across the surface causing any compacted matter to become detached from the surface and/or become fragmented. An engine or motor for the brooms may be located at various locations of the vehicle 10 based on availability of space and, for example, may be embodied as part of a trailer on which the air blowing section 20 is located. Similarly to the diverting section 16, the sweeping section 18 may be oriented at an acute angle about a transverse axis so that matter is swept or shifted laterally about the apparatus 10 and can be processed by a subsequent apparatus. Any remaining matter that is not shifted laterally by the diverting section 16 or the sweeping section 18 may be blown away or shifted laterally by the air blowing section 20 toward the same lateral side to which the diverting section 16 and the sweeping section 18 is oriented. The air blowing section 20 thus may be located rearward of the sweeping section 18 and may be any device capable of generating air movement, such as a fan. However, it is not necessary for the air blowing section 20 to work in conjunction with the diverting section 16 or the sweeping section 18 and the air blowing section 20 may be provided on the apparatus 10 without the diverting section 16 or the sweeping section 18. Moreover, it may be possible for the sweeping section 18 or the air blowing section 20 to generate sufficient lateral shifting or displacement so that it is not necessary for a subsequent apparatus to follow a preceding apparatus 10 for further processing of the matter.

Figure 13:
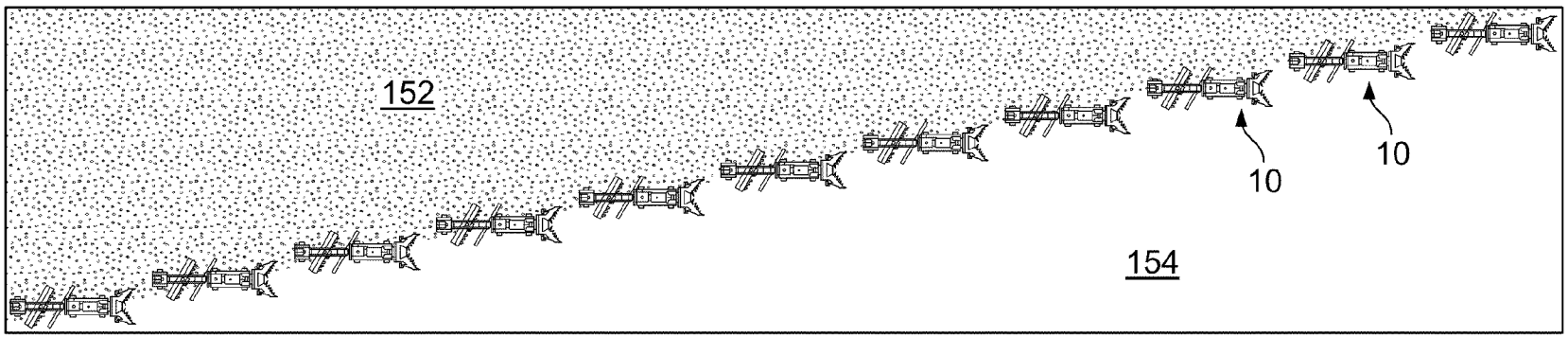
FIG. 13 is an arrangement of a plurality of multifunctional apparatus in order to clear a surface.

FIG. 13 shows one method of using a plurality of the above-described apparatus 10 to clear a surface. Because a surface treated by the above-described apparatus 10 may be vast in area, a plurality of apparatus 10 is required to quickly and efficiently accomplish a large-scale cleaning task. Such a task can be accomplished using the present apparatus 10 in conjunction with other apparatus in the art, for example, because the purchase of a plurality of the apparatus 10 may be so costly that the acquisitions need to be made gradually over time. During such transition period, it may be necessary to utilize the present apparatus 10 with other apparatus in the art. However, the method illustrated in FIG. 13 utilizes the above-described apparatus 10 only. The apparatus 10 proceed in a staggered fashion in the same direction of travel, i.e., from left to the right in FIG. 13, and are spaced apart transversely about the direction of travel so that substantially all parts of the surface are passed over or traversed by at least one apparatus 10. The left side 152 of FIG. 13 indicates a surface that has been cleared of matter whereas a right side 154 of FIG. 13 indicates a surface that is covered with matter. In this method of use, there may be some overlap as to the paths traveled by different apparatus 10 but, since the apparatus 10 do not proceed directly adjacent one another, this is possible and may actually result in a more extensive coverage of the surface that is cleaned. Using the above-described apparatus 10, a bulk of the matter can be removed from the surface through the collecting section 12 and the casting section 14. Any matter that may remain after processing by the collecting section 12 and the casting section 14 may be shifted laterally of the apparatus 10 by any type of shifting section so that such matter can be gathered by the collecting section 12 of a subsequent apparatus 10 that trails a preceding apparatus 10. It must be noted that the apparatus 10 in FIG. 13 is equipped with the three types of shifting section which shifts matter toward the right side of the vehicle 10 or the bottom in FIG. 13. Any type of shifting section is independently capable of shifting matter laterally of the apparatus 10 so that a subsequent apparatus can process the matter. However, as in FIG. 13, different types of shifting sections can be used together to complement each other and increase the overall effectiveness of matter clearance. For example, any matter that was not gathered the diverting section 16, possibly due to pavement irregularities, cutting edge clearance, or the high degree of compactness, may become fragmented by the sweeping section 18 and be shifted laterally of the apparatus 10 by the bristles of the rotating broom whose axis is at an angle to a transverse axis. Additionally, any matter that was not shifted by the rotating bristles may be blown away by the air blowing section 20 and shifted laterally for processing by a subsequent apparatus 10. Also, if an apparatus 10 is near the edge of a surface, a subsequent apparatus may not be necessary to process the shifted matter and the shifting or displacement of the matter provided by shifting section of the apparatus 10 may by itself be sufficient.

It will be apparent to those skilled in the art that various modifications and variations can be made without departing from the spirit and scope of the claimed invention.

The invention claimed is:

1. A method of clearing an accumulation of matter from a surface using a first apparatus, the first apparatus including a collecting section, a casting section, and a shifting section, the shifting section being at least one of a diverting section, a sweeping section, and an air blowing section, the diverting section including an auxiliary blade oriented at an angle about an axis transverse to a direction of travel, the sweeping section including a rotatable broom with bristles, the air blowing section configured to blow air in a predetermined direction, the collecting section including a blade and in matter communication with the casting section, the method including the steps of:

collecting matter by moving the blade in proximity with a surface;

casting matter channeled from the collecting section away from a surface; and shifting matter laterally of the apparatus; wherein the step of shifting matter laterally of the apparatus is at least one of:

diverting matter laterally of the apparatus by moving the auxiliary blade in greater proximity with a surface;

rotating the broom so that the bristles strike matter on a surface; and directing air towards matter so as to move matter in the predetermined direction.

2. The method of claim 1, further including the step of:

using a second apparatus, the second apparatus including a collecting section, a casting section, and a shifting section, the collecting section including a blade and in matter communication with the casting section;

moving the first multi-functional apparatus and the second multi-functional apparatus over a surface along the direction of travel, the second apparatus disposed at a delayed interval about the first apparatus and transversely offset about the first apparatus such that the second apparatus can repeat steps of collecting matter, casting matter, and shifting matter.

3. The method of claim 1, further including a plurality of shifting sections.

* * * * *